United States Patent [19]

Kristen

[11] Patent Number: 4,660,355

[45] Date of Patent: Apr. 28, 1987

[54] VACUUM ADAPTER FOR METAL-LID CANNING JARS

[76] Inventor: Hanns J. Kristen, 58 Indian Rock Rd., San Anselino, Calif. 94960

[21] Appl. No.: 817,471

[22] Filed: Mar. 13, 1986

[51] Int. Cl.[4] ..... B65B 31/04

[52] U.S. Cl. ..... 53/510; 53/88; 215/277; 215/341

[58] Field of Search ..... 53/88, 103, 510; 285/111

[56] References Cited

U.S. PATENT DOCUMENTS 2,406,771 9/1946 Hughes ..... 53/88

2,436,849 3/1948 Billetter ..... 53/88 X 2,751,927 6/1956 Kinney ..... 285/111 X 4,372,096 2/1983 Baum ..... 53/88

*Primary Examiner*—Donald F. Norton

*Attorney, Agent, or Firm*—Limbach, Limbach & Sutton

[57] ABSTRACT

The invention discloses a bell-shaped adapter which facilitates the extraction of air from canning jars fitted with metallic disc type lids. The device operates in conjunction with a vacuum pump. Used on standard canning jars (such as Mason-, Kerr-, Ball-Jars) it is suitable for vacuum sealing perishables in the kitchen or home.

3 Claims, 2 Drawing Figures

VACUUM ADAPTER FOR METAL-LID CANNING JARS

BACKGROUND OF THE INVENTION

1. Field of the Invention

The present invention relates to vacuum devices and, in particular, to an adapter for extracting air from canning jars which are fitted with metal disc-type lids.

2. Description of the Prior Art

Vacuum sealing of perishables in the home and kitchen is becoming more important as people become more aware of the dangers of food preservatives and, consequently, return to natural and healthy foods. Storing foods in a vacuum is a non-chemical way to help preserve freshness.

Most available vacuum sealers are poorly suited for home use because they rely on large vacuum chambers into which the food container is placed while the air is extracted. Besides the large size and space requirement and their high cost, they are inefficient due to the fact that the entire chamber has to be evacuated and not just the food container itself.

SUMMARY OF THE INVENTION

The adapter of the present invention recognizes the fact that metal disc-type home canning jars in standard sizes are readily available in supermarkets and drugstores and exist in most homes. While the air is being extracted from the jar, its metal disc lid functions like a one-way valve, sealing the mouth of the jar air tight as soon as the pump stops. In addition, when atmospheric pressure is allowed to enter the space above the lid, the pressure secures the lid seal. After the adapter is removed, the retainer ring of the lid is screwed down to secure the disc in place.

Since only the air in the jar, and not the air in a large surrounding chamber or glass dome, is extracted, the adapter of the present invention provides an efficient one-step evacuating operation which employs a much smaller vacuum pump.

DETAILED DESCRIPTION OF A PREFERRED EMBODIMENT

Figure 1A:
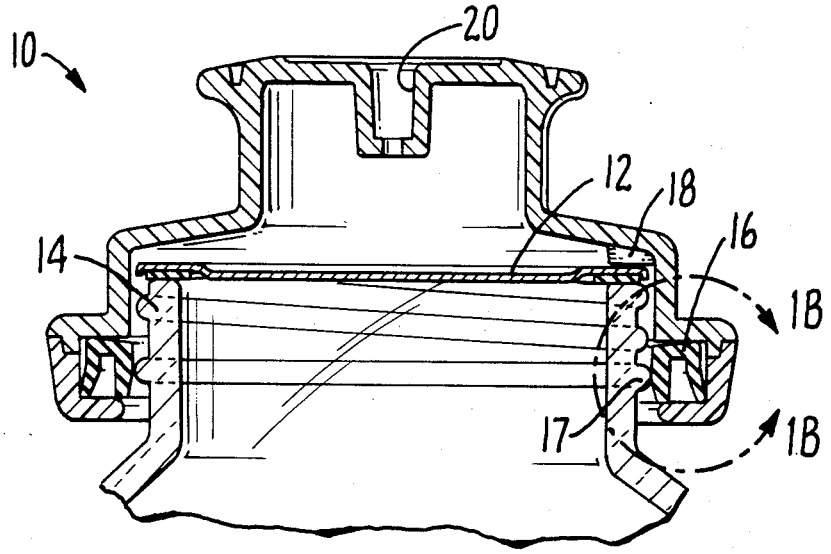
FIG. 1A is a cross-sectional view illustrating the vacuum adapter of the present invention mounted on a canning jar.
Figure 1B:
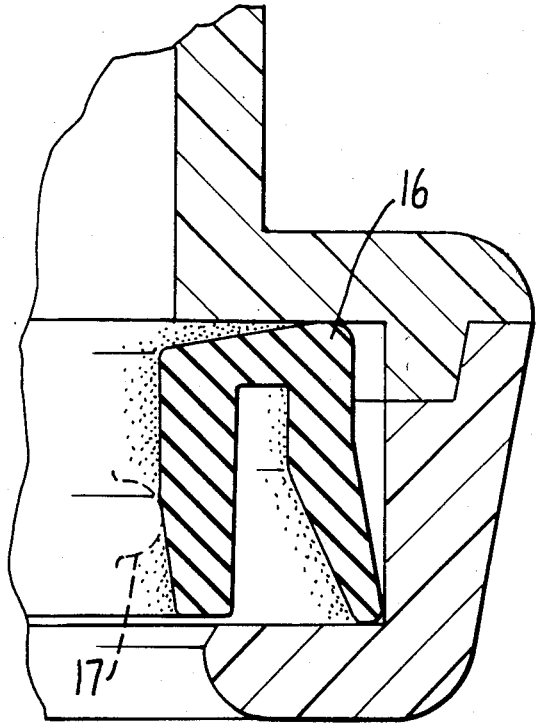
FIG. 1B is a cross-sectional blow-up of the vacuum adapter gasket.

FIG. 1A shows a cross-section view of a vacuum adapter 10 in accordance with the present invention for an 86 mm standard ("Wide Mouth") canning jar.

A metal disc lid 12 is loosely placed on the mouth of the jar 14 while the metal retaining ring of the lid is left aside. The adapter 10 is pushed down over the mouth of the jar which forces a rubber gasket 16 to expand slightly and form a seal with a bulge 17 formed below the jar thread. The adapter 10 rests on three points 18 placed at 120° spacings at the circumference of the lid 12.

While air is being extracted through a hose (not shown) attached to an opening 20 in the adapter 10 by means of a vacuum pump, a vacuum is being created in the space above the lid 12. This has three effects: (1) the specially designed gasket 16 pushes even tighter around the glass bulge 17, forming an even tighter seal; (2) the entire adapter 10 is pushed down on the jar by atmospheric pressure, and (3) the metal disc lid 12 is pushed upwards by the air pressure in the jar.

Since the lid is held down firmly at three points 18, it cannot move in its entirety, but bends upward elastically in the three sectors between these three points. Air can now escape from the jar into the space above the lid 12 through the three slots thus formed.

Since the force bending the lid 12 is proportional to the pressure differential below and above the lid 12, the upward bending decreases as this differential decreases. When the pressures above and below the lid 12 are identical (i.e. when the pump reaches its maximum vacuum), there will be no more upward bending, the slots will have disappeared and the lid 12 will seal the jar (due to the atmospheric pressure forcing the attachment firmly down on the lid).

Disconnecting the pump allows atmospheric air to rush through the opening 20, pushing the entire lid 12 firmly on the jar and freeing the adapter 10 so it can be easily removed. The metal retaining ring is now placed over the lid 12 and screwed down to hold the lid 12 in place.

The vacuum in the jar can easily be monitored over time by observing the concaveness (deflection) of the metal lid 12.

It should be understood that various alternatives to the embodiment described herein may be employed in practicing the present invention. It is intended that the following claims define the invention and that the structure within the scope of these claims and their equivalents be covered thereby.

Having described my invention I claim:

1. A vacuum adapter for evacuating a canning jar of the type having a disc-type lid which engages the mouth of the jar and a bulge on its exterior periphery, the vacuum adapter comprising:

(a) a generally concave body portion that defines an interior cavity such that the adapter may be placed over the mouth of the jar, the body portion including a flexible gasket which engages the bulge to form a seal therewith;

(b) a plurality of points formed on the interior surface of the body portion for forcing corresponding points of the lid into engagement with the mouth of the jar when the interior cavity is evacuated such that the lid bends upward elastically in the sectors between the points of engagement between the mouth of the jar and the lid; and (c) means for extracting air from the interior cavity such that air is also evacuated from the interior of the jar through openings formed by the upwardly bent sectors of the lid.

2. A vacuum adapter as in claim 1 and having three points for forcing corresponding points of the lid into engagement with the mouth of the jar.

3. A vacuum adapter as in claim 2 wherein the three points are placed at 120° spacings.

* * * * *